US012343782B2

(12) United States Patent
Fukumoto

(10) Patent No.: US 12,343,782 B2
(45) Date of Patent: Jul. 1, 2025

(54) CAN CONTAINER AND METHOD FOR PRODUCING SAME

(71) Applicant: TOYO SEIKAN CO., LTD., Tokyo (JP)

(72) Inventor: Hayato Fukumoto, Kanagawa (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 208 days.

(21) Appl. No.: 17/909,872

(22) PCT Filed: Dec. 21, 2020

(86) PCT No.: PCT/JP2020/047764
§ 371 (c)(1),
(2) Date: Sep. 7, 2022

(87) PCT Pub. No.: WO2021/186829
PCT Pub. Date: Sep. 23, 2021

(65) Prior Publication Data

US 2023/0173570 A1 Jun. 8, 2023

(30) Foreign Application Priority Data

Mar. 18, 2020 (JP) ..... 2020-048285

(51) Int. Cl.
*B21D 51/26* (2006.01)
*B65D 1/16* (2006.01)
*B65D 1/46* (2006.01)

(52) U.S. Cl.
CPC ..... *B21D 51/26* (2013.01); *B65D 1/16* (2013.01); *B65D 1/46* (2013.01)

(58) Field of Classification Search
CPC ..... B21D 5/16; B21D 51/2653; B21D 22/30; B65D 1/16; B65D 1/46
See application file for complete search history.

(56) References Cited

U.S. PATENT DOCUMENTS 3,942,673 A 3/1976 Lyu et al.
4,919,294 A 4/1990 Kawamoto et al.
(Continued)

FOREIGN PATENT DOCUMENTS

CN 1310681 A 8/2001
CN 101242918 A 8/2008
(Continued)

OTHER PUBLICATIONS

International Search Report and Written Opinion of the International Searching Authority issued in International Patent Application No. PCT/JP2020/047764, dated Feb. 9, 2021, along with an English translation thereof.
(Continued)

*Primary Examiner* — Teresa M Ekiert
(74) *Attorney, Agent, or Firm* — GREENBLUM & BERNSTEIN P.L.C.

(57) ABSTRACT

A can container includes a can barrel and a can bottom; the can bottom includes a dome part which is concaved toward an inner side of the can container along a direction of a can axis at a center, and also includes an annular convex part which projects toward an outer side of the can container so as to shape an annular support part on an outer periphery of the dome part: and the dome part has a central dome part which is positioned on the can axis and has a set radius of curvature, and an outer peripheral dome part which is shaped continuously on an outer side of the central dome part, has a center of curvature positioned on the can axis, and has a radius of curvature smaller than the radius of curvature of the central dome part.

8 Claims, 3 Drawing Sheets

(56) References Cited

U.S. PATENT DOCUMENTS

| | | | | |
|---|---|---|---|---|
| 5,704,241 | A | 1/1998 | Babbitt et al. | |
| 6,131,761 | A * | 10/2000 | Cheng | B65D 1/165 220/608 |
| 6,132,155 | A * | 10/2000 | Gouliard | B21D 51/26 413/1 |
| 7,395,686 | B2 * | 7/2008 | Dervy | B21D 22/30 72/379.4 |
| 8,286,459 | B2 | 10/2012 | Kubo | |
| 2001/0009107 | A1 | 7/2001 | Chen | |
| 2009/0218250 | A1 | 9/2009 | Kubo | |
| 2016/0318645 | A1 | 11/2016 | Wersuhn | |

FOREIGN PATENT DOCUMENTS

| | | | |
|---|---|---|---|
| CN | 204916414 | U | 12/2015 |
| CN | 105899433 | A | 8/2016 |
| DE | 1020 15215590 | A1 | 2/2017 |
| JP | 53-146310 | A | 12/1978 |
| JP | 2-45353 | A | 2/1990 |
| JP | 9-285832 | A | 11/1997 |
| JP | 2001-139012 | A | 5/2001 |
| JP | 2005-001670 | A | 1/2005 |
| JP | 2007-045458 | A | 2/2007 |
| JP | 3916817 | B2 | 5/2007 |
| JP | 2009-292480 | A | 12/2009 |
| JP | 2015-214343 | A | 12/2015 |
| JP | 2016-43991 | A | 4/2016 |
| JP | 2017-136604 | A | 8/2017 |
| TW | 2020 27875 | | 8/2020 |

OTHER PUBLICATIONS

Office Action in Taiwanese family member application No. 110106453, dated Sep. 28, 2021, and English translation thereof.

Office Action in Chinese family member Application No. 202080097319.4, dated Apr. 18, 2023 and English language translation thereof.

Office Action dated Mar. 12, 2024 in corresponding Vietnamese family member Application No. 1-2022-04979 and English language translation thereof.

Supplementary European Search Report dated Mar. 18, 2024 in corresponding European family member Application No. 20926271.6.

Office Action dated Aug. 29, 2024 in Thailand family member Application No. 2201005761, and English language translation thereof.

Office Action dated Jan. 7, 2025 in Japanese family member application No. 2022-508067 with English language translation thereof.

Office Action, dated Oct. 15, 2024, in Japanese family member application No. Patent Application No. 2022-508067 with English language translation thereof.

* cited by examiner

CAN CONTAINER AND METHOD FOR PRODUCING SAME

TECHNICAL FIELD

The present invention relates to a can container and a method for producing the same.

BACKGROUND ART

As a can container in which contents such as drink and food are filled and sealed, a two-piece can and a bottle can are known. The can container includes at least a can barrel and a can bottom.

In such a can container, in order to reduce raw materials to be used, the weight of the container is reduced by reducing the thickness of the container. In order to obtain predetermined strength as the container even in the case where the thickness thereof is reduced, the shape of the can bottom is devised as required.

In general, as the shape of the can bottom, a dome part obtained by concaving a central part of the can bottom into a dome shape toward an inner side of the can container along a can axis direction is shaped, and an annular convex part serving as a support part is shaped on an outer peripheral edge of the dome part.

In addition, as the conventional art, the shapes of the dome part and the annular convex part described above are appropriately designed and, for example, there is proposed a can bottom in which a first concave curved surface part formed into a curved line which is concaved toward an outer side in a radial direction orthogonal to a can axis in a vertical cross section view along the can axis direction is shaped on an inner peripheral wall of the annular convex part which is coupled to the dome part, a dome top positioned on the can axis and a second concave curved surface part which is connected to an outer side of the dome top in the radial direction and is formed into a concave curved line having a radius of curvature smaller than that of the dome top are shaped in the dome part, and a tapered part formed into a straight line which is in contact with the first concave curved surface part and the second concave curved surface part is shaped by connecting the first concave curved surface part and the second concave curved surface part in an outer peripheral edge part of the dome part (see PTL 1 described below).

CITATION LIST

Patent Literature

[PTL 1] Japanese Patent Application Publication No. 2016-43991

SUMMARY OF INVENTION

Technical Problem

In the can container having the above-described dome part provided in the can bottom, when the depth of the concave part is reduced by increasing the radius of curvature of the dome part in order to secure the volume of the container, in the case where the can container falls during transport, a water hammer phenomenon by contents occurs due to a shock at the time of the fall, and a problem in which the dome part is inverted easily occurs. In particular, in a can container made of an aluminum alloy of which a further reduction in thickness is required in order to save resources and reduce weight, even when a falling height is about several tens of centimeters, there are cases where the inversion of the dome part described above occurs, and hence an improvement in falling strength is an issue to be addressed in order to increase a product yield during transport.

In contrast, in the conventional art described above, the second concave curved surface part formed into the concave curved line having the radius of curvature significantly smaller than that of the dome top positioned on the can axis is shaped in the outer peripheral edge part of the dome part (in the case where the radius of curvature of the dome top is 48 mm, the radius of curvature of the second concave curved surface part is 3.0 to 5.0 mm), and the tapered part formed into the straight line is shaped so as to come into contact with the second concave curved surface part. According to the above conventional art, when the can container is caused to fall and a load is applied to a grounding part of the can bottom, a phenomenon in which, with the second concave curved surface part having the small radius of curvature between the tapered part and the outer peripheral edge of the dome part which functions as a starting point, the dome part is inverted due to the above-described water hammer phenomenon easily occurs. Accordingly, a problem arises in that, in the case of the shape of the can bottom of the conventional art, it is not possible to increase the falling strength.

In addition, according to the conventional art described above, while the first concave curved surface part and the tapered part described above are shaped by performing re-forming on the inner peripheral wall of the above annular convex part after the dome part and the annular convex part are formed in the bottom part, in the first concave curved surface part, a curved surface is formed with a forming surface of a roll forming tool. In such roll forming, the curved surface of the first concave curved surface part needs to have the radius of curvature which is large to some extent such that the roll forming is allowed, and it is not possible to increase a concave amount with which an inner peripheral surface of the annular convex part is concaved toward the outer side in the radial direction orthogonal to the can axis. Consequently, even when the re-forming is performed, a problem arises in that it is not possible to obtain an effective improvement in pressure resistance strength.

The present invention has been proposed in order to cope with such circumstances. That is, an object thereof is to obtain higher falling strength and higher pressure resistance strength by improving the shape of a can bottom in a can container.

Solution to Problem

In order to solve such a problem, a can container according to the present invention includes the following configuration.

The can container includes a can barrel and a can bottom, the can bottom includes a dome part which is concaved toward an inner side of the can container along a direction of a can axis at a center and also includes an annular convex part which projects toward an outer side of the can container so as to shape an annular support part on an outer periphery of the dome part, and the dome part has a central dome part which is positioned on the can axis and has a set radius of curvature, and an outer peripheral dome part which is shaped continuously on an outer side of the central dome part, has a center of curvature positioned on the can axis, and has a radius of curvature smaller than the radius of curvature of the central dome part.

A method for producing a can container is a method for producing a can container including a can barrel and a can bottom, wherein, after shaping a dome part which is concaved toward an inner side of the can container along a direction of a can axis at a center in the can bottom and also shaping an annular convex part which projects toward an outer side of the can container so as to shape an annular support part on an outer periphery of the dome part, when plastic work is performed by pressing a forming tool having a working surface along a curved surface of the dome part against the dome part from the inner side of the can container along the direction of the can axis, the working surface of the forming tool has a center of curvature positioned on the can axis and a radius of curvature smaller than a radius of curvature at a center of the dome part, and has a radius which is not less than a radius perpendicular to the can axis up to an outermost part from the can axis of the dome part in a vertical cross section view which includes the can axis and is along the direction of the can axis.

Advantageous Effects of Invention

According to the can container and the method for producing the same having such features, even in the case of the can container made of an aluminum alloy which is reduced in thickness, it is possible to provide the can container having higher falling strength and higher pressure resistance strength by improving the shape of the bottom part of the can container.

DESCRIPTION OF EMBODIMENTS

Figure 3:
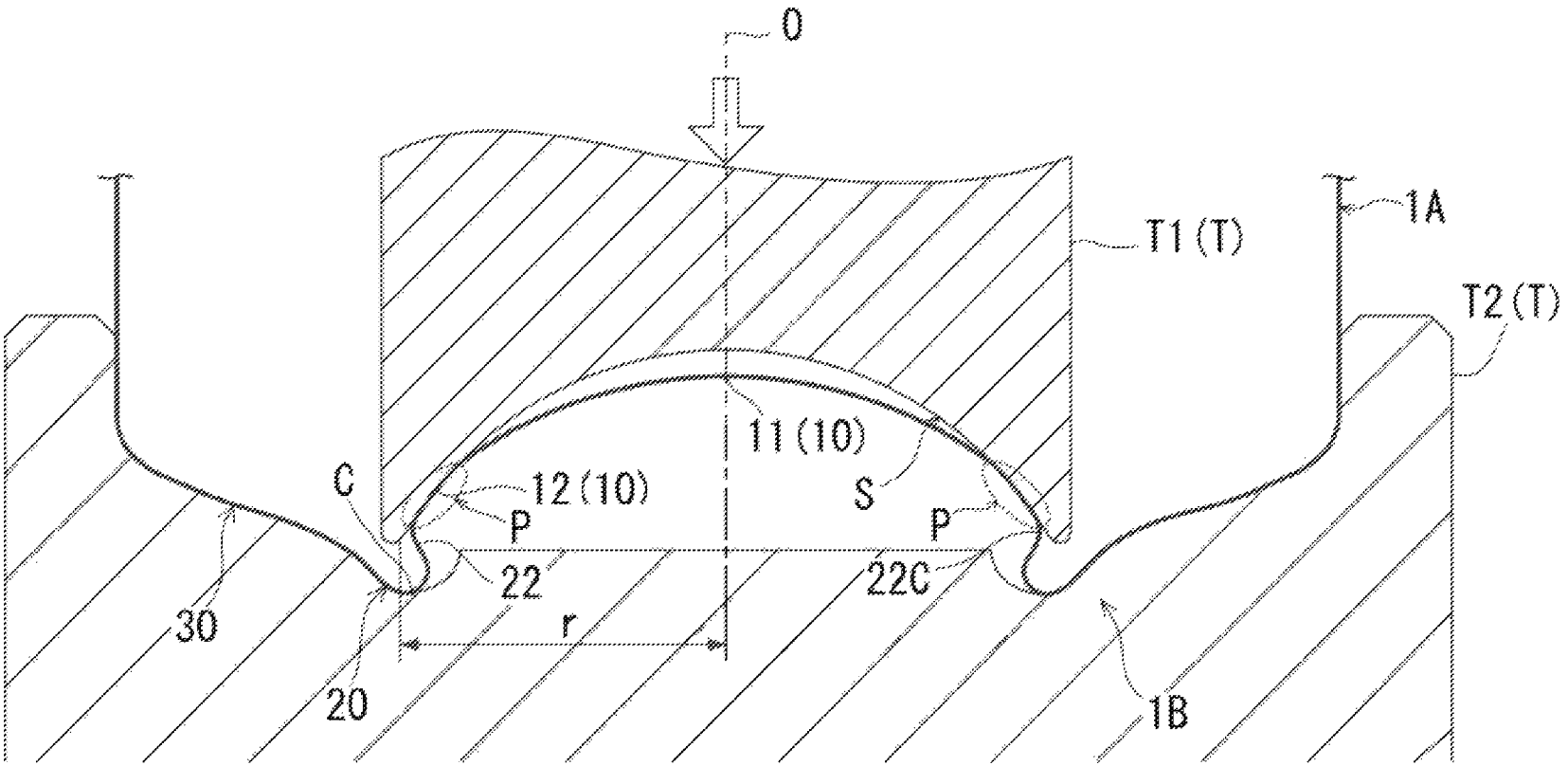
FIG. 3 is an explanatory view (a longitudinal sectional view which includes the can axis O and is along the direction of the can axis O) for explaining a method for producing the can container according to the embodiment of the present invention.

Hereinbelow, an embodiment of the present invention will be described with reference to the drawings. In the following description, the same reference numerals in different drawings denote parts having the same functions, and a duplicate description for each drawing will be appropriately omitted. In addition, each of sectional views in FIG. 1 and FIG. 3 shows a sectional shape with a diagram in which the illustration of a thickness is omitted.

Figure 1:
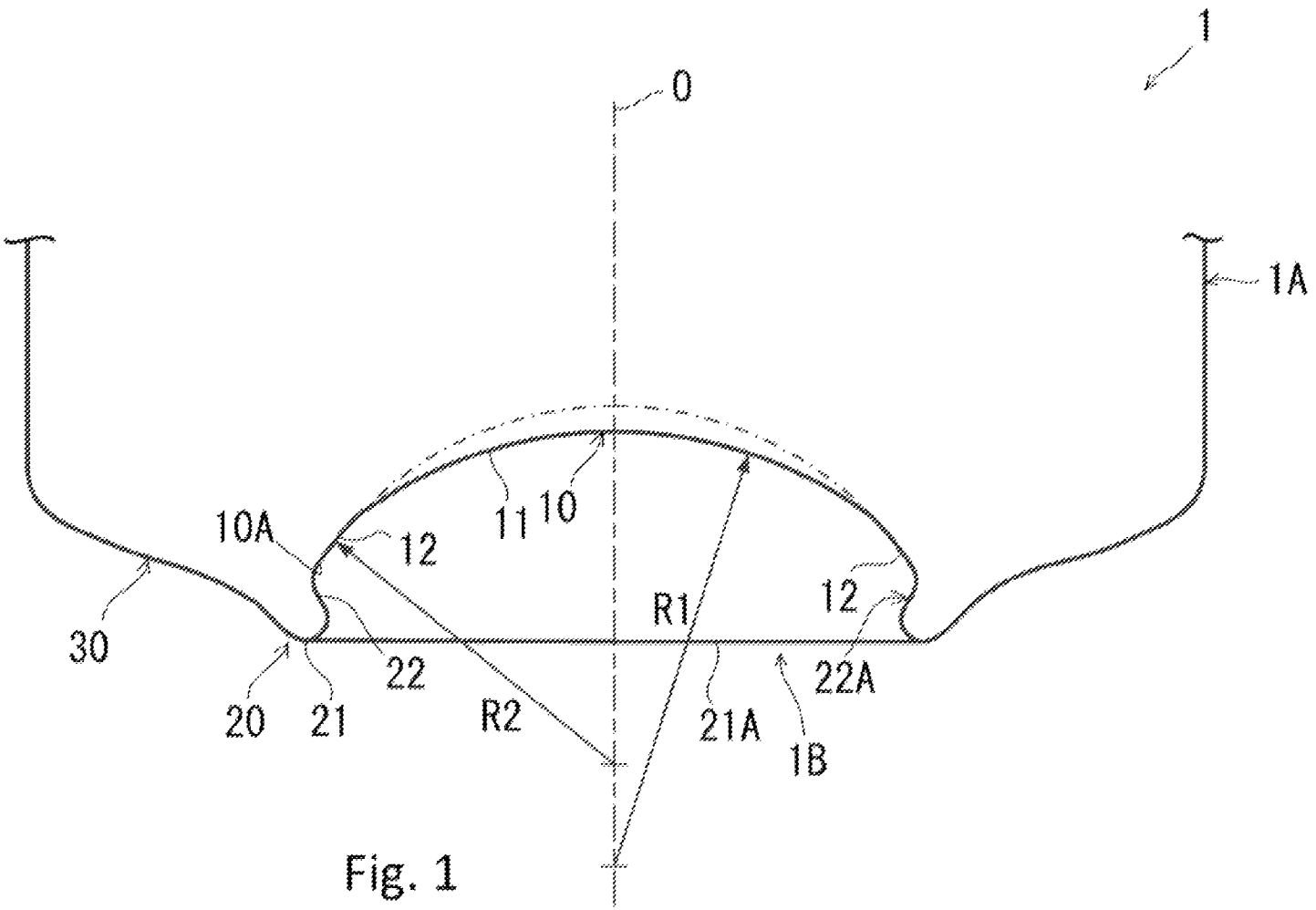
FIG. 1 is a longitudinal sectional view of a principal part (a longitudinal sectional view which includes a can axis O and is along a direction of the can axis O) of a can container according to an embodiment of the present invention.

As shown in FIG. 1, a can container 1 according to the embodiment of the present invention has a can barrel 1A and a can bottom 1, and the can barrel 1A and the can bottom 1B have the same shape over the entire circumference, respectively, about a can axis O in a vertical cross section view which includes the can axis O and is along a direction of the can axis O. Herein, the can bottom 1B includes a dome part 10 and an annular convex part 20 and, in an example shown in the drawing, the can bottom 1B includes an outer wall part 30 which is coupled to the can barrel 1A on an outer side of the annular convex part 20.

The dome part 10 is provided at the center of the can bottom 1B, and has a curved surface which is formed to be concaved into a dome shape toward an inner side of the can container 1 along the direction of the can axis O. The dome part 10 has a central dome part 11 which is positioned on the can axis and has a set radius of curvature R1, and an outer peripheral dome part 12 which is shaped continuously on an outer side of the central dome part 11, has a center of curvature positioned on the can axis O, and has a radius of curvature R2 smaller than the radius of curvature R1 of the central dome part 11. As shown in the drawing, each of the radius of curvature R1 of the central dome part 11 and the radius of curvature R2 of the outer peripheral dome part 12 has the center of curvature on the can axis O, and the center of curvature of the outer peripheral dome part 12 is positioned above the center of curvature of the central dome part 11.

The annular convex part 20 is shaped to project toward an outer side of the can container 1 along the direction of the can axis so as to shape an annular support part 21 on an outer periphery of the dome part 10. The support part 21 is a part which grounds the can container 1.

Figure 2:
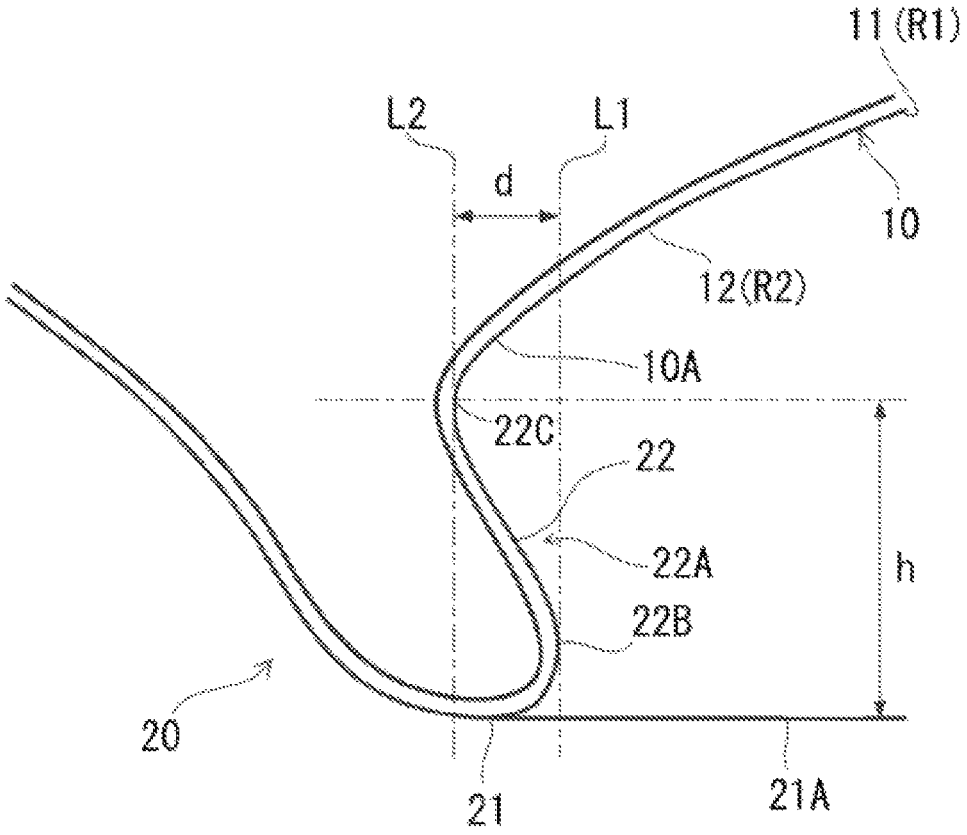
FIG. 2 is an enlarged view of the principal part in FIG. 1.

As shown in FIG. 2, in the can bottom 1, an inner peripheral surface 22 which extends from the support part 21 of the annular convex part 20 to an outer peripheral edge part 10A of the dome part 10 has a recessed part 22A in which the inner peripheral surface 22 is inclined in a direction away from the can axis O and is coupled to the outer peripheral edge part (an outer peripheral edge part of the outer peripheral dome part 12) 10A of the dome part 10.

The recessed part 22A shaped in the inner peripheral surface 22 of the annular convex part 20 is inclined in the direction away from the can axis O upward from an innermost part 22B (a part in the inner peripheral surface 22 closest to the can axis O) of the inner peripheral surface 22, and the outer peripheral edge part (the outer peripheral edge part of the outer peripheral dome part 12) 10A of the dome part 10 is positioned in the direction away from the can axis O with respect to the innermost part 22B (the part in the inner peripheral surface 22 closest to the can axis O) of the inner peripheral surface 22. With this, a virtual line L1 which is in contact with the innermost part 22B of the inner peripheral surface 22 and is parallel to the can axis O intersects the outer peripheral dome part 12.

The can container 1 having such a can bottom shape is shaped by performing finish forming (re-forming) by using a forming tool T (an inner tool T1 and an outer tool T2) shown in FIG. 3 after the dome part 10 and the annular convex part 20 having the support part 21 are pre-formed in the can bottom 1B. At this point, both of the forming of the dome part 10 and the forming of the annular convex part 20 are performed with the forming tool T. In an example shown in FIG. 3, the forming of the dome part 10 and the forming of the annular convex part 20 are performed at the same time with the forming tool T including the inner tool T1 and the outer tool T2, but they may be performed separately.

The inner tool T1 performs forming work on the curved surface of the dome part 10 from an inner side of the can container 1, and has a working surface S along the curved surface of the dome part 10. The working surface S has a center of curvature on the can axis O, has a radius of curvature R2 smaller than the radius of curvature R1 of the pre-formed dome part, and has a tool radius r which is not less than a radius perpendicular to the can axis O up to an outermost part from the can axis O of the dome part 10.

In the forming work of the dome part 10, the working surface S of the inner tool T1 is pressed against the dome part 10 which is formed to have the radius of curvature R1 by pre-forming from the inner side of the can container 1 along the direction of the can axis O. With this, in the dome part 10, the curved surface of the outer peripheral dome part 12 having the radius of curvature R2 (R2<R1) is formed by the forming work in a part P against which the working surface S is pressed, and a part against which the working surface S of the inner tool T1 is not pressed and is not subjected to the forming work serves as the central dome part 11 having the radius of curvature R1.

At this point, with regard to the inner tool T1, only a part P of an outer periphery of the working surface S is pressed against the dome part 10 and the forming work is performed, and hence the working surface S may be made hollow such that a central part of the working surface S which is not pressed against the dome part 10 is removed.

The outer tool T2 has a chuck C for performing the forming work on the annular convex part 20 of the can bottom 1B. As described above, the forming of the dome part 10 is performed by downward pressing of the inner tool T1, and the forming work of the annular convex part 20 is performed by entry of the annular convex part 20 into the chuck C according to the type and shape of the chuck C.

As shown in FIG. 2, the inner peripheral surface 22 of the annular convex part 20 having been subjected to the forming work reaches the outer peripheral edge part (the outer peripheral edge part of the outer peripheral dome part 12) 10A of the dome part 10 via a concave of an outermost part 22C (a part in the inner peripheral surface 22 farthest from the can axis O) in the inner peripheral surface 22. The outermost part 22C is a bent part subjected to plastic work by compressing by the forming tool T. With this, the radius of curvature of a curved surface of the outermost part 22C can be set to be smaller than the radius of curvature of the first concave curved surface part in the conventional art (e.g., not more than 0.7 mm).

The outermost part 22C shaped in this manner can be concaved in the direction away from the can axis O more deeply with respect to the innermost part 22B in the inner peripheral surface 22. Herein, when it is assumed that a virtual line which is in contact with the outermost part 22C and is parallel to the can axis O is L2, a distance d (the depth of the recessed part 22A) between the above-described virtual line L1 and the virtual line L2 is preferably set to 0.3 mm to 1.0 mm for increasing the pressure resistance strength of the can bottom 1. In addition, when the outermost part 22C is shaped by the plastic work by compressing, a height h from a support surface 21A to the outermost part 22C serves as a forming height. The height h is preferably set to 2.0 mm to 4.0 mm for increasing the pressure resistance strength of the can bottom 1B.

The outermost part 22C of the inner peripheral surface 22 is the bent part having been subjected to the plastic work by compressing, whereby roll forming in the conventional art is not necessary. Consequently, a roll forming trace which occurs when a curved surface is shaped by roll forming is not present in the inner peripheral surface 22 of the annular convex part 20. With this, in the inner peripheral surface 22, it is possible to avoid disfigurement by the roll forming trace (black discoloration by destruction of an aluminum oxide film) which occurs during heat sterilization or the like.

The embodiment of the present invention having the can bottom shape described above has high falling strength as compared with those of the above-described conventional art and a can container in which the dome part is shaped by using a single radius of curvature. Table 1 shows results of falling tests conducted in Example in which the radius of curvature R1 of the central dome part 11 is set to 42 mm and the radius of curvature R2 of the outer peripheral dome part 12 is set to 35 mm, Comparative Example 1 in which the can bottom shape of the above-described conventional art is used, and Comparative Example 2 in which the dome part has the single radius of curvature of 42 mm (conditions such as thicknesses in Example and Comparative Examples 1 and 2 are identical to each other, and the falling height is set to 25 cm.).

TABLE 1

| Example | Comparative Example 1 | Comparative Example 2 |
|---|---|---|
| 0/20 | 3/3 | 4/4 |

The results of Table 1 show that, out of twenty can containers, the number of can containers in each of which the inversion of the dome part has occurred is zero in Example, out of three can containers, the number of can containers in each of which the inversion of the dome part has occurred is three in Comparative Example 1, and, out of four can containers, the number of can containers in each of which the inversion of the dome part has occurred is four in Comparative Example 2. As is clear from the results, Example of the present invention has high falling strength as compared with those of the above-described conventional art and the can container in which the dome part is shaped by using the single radius of curvature.

The reason for the high falling strength of the embodiment of the present invention is that an angle of tangent of the curved surface in the outer peripheral edge part of the dome part 10 is increased by making the radius of curvature R2 of the outer peripheral dome part 12 smaller than the radius of curvature R1 of the central dome part 11. The inversion of the dome part caused by the water hammer phenomenon which occurs at the time of falling of the can container occurs with the outer peripheral edge part of the dome part which functions as the starting point, and hence resistance to the pressure of the water hammer phenomenon is increased by increasing the angle of tangent.

In addition, the embodiment of the present invention has high can bottom pressure resistance strength as compared with that of the above-described conventional art. The can bottom pressure resistance strength mentioned herein denotes buckling strength until the concave shape of the can bottom is completely inverted due to an increase in pressure in the can container. The above-described recessed part 22A is shaped by the forming tool T after the pre-forming of the dome part 10 and the annular convex part 20 is performed in the can bottom 1B. By reducing an inclination angle of the inner peripheral surface 22 of the recessed part 22A to a proper angle, it is possible to concave the outermost part 22C in the inner peripheral surface 22 of the annular convex part 20 in the direction away from the can axis O more deeply, and increase the above-described buckling strength.

While the embodiment of the present invention has been described in detail with reference to the drawings, the specific configuration is not limited to the embodiment, and design changes and the like made within the scope that does not depart from the gist of the present invention are included in the present invention.

REFERENCE SIGNS LIST

1 Can container
1A Can barrel

1B Can bottom
10 Dome part
10A Outer peripheral edge part
11 Central dome part
12 Outer peripheral dome part
20 Annular convex part
21 Support part
21A Support surface
22 Inner peripheral surface
22A Recessed part
22B Innermost part
22C Outermost part
30 Outer wall part
O Can axis

What is claimed is:

1. A can container comprising:

a can barrel; and a can bottom, wherein the can bottom includes a dome part which is concaved toward an inner side of the can container along a direction of a can axis at a center and also includes an annular convex part which projects toward an outer side of the can container so as to shape an annular support part on an outer periphery of the dome part, and the dome part has:

a central dome part which is positioned on the can axis and has a set radius of curvature, and an outer peripheral dome part which is shaped continuously on an outer side of the central dome part, has a center of curvature positioned on the can axis, and has a radius of curvature smaller than the radius of curvature of the central dome part.

2. The can container according to claim 1, wherein a curved surface of the outer peripheral dome part is a forming work surface obtained by a press of a tool.

3. The can container according to claim 1, wherein, in an inner peripheral surface extending from the support part to an outer peripheral edge part of the outer peripheral dome part, the outer peripheral edge part is positioned in a direction away from the can axis to be farther from the can axis than an innermost part of the inner peripheral surface.

4. The can container according to claim 3, wherein an outermost part of the inner peripheral surface is a bent part subjected to plastic work by compressing.

5. The can container according to claim 4, wherein a roll forming trace is not present in the inner peripheral surface.

6. The can container according to claim 3, wherein a roll forming trace is not present in the inner peripheral surface.

7. A method for producing a can container including a can barrel and a can bottom, comprising, shaping a dome part which is concaved toward an inner side of the can container along a direction of a can axis at a center in the can bottom, shaping an annular convex part which projects toward an outer side of the can container so as to shape an annular support part on an outer periphery of the dome part, and after the shaping the dome part and the shaping the annular convex part, performing plastic working by pressing a forming tool having a working surface along a curved surface of the dome part against the dome part from the inner side of the can container along the direction of the can axis, wherein the working surface of the forming tool has a center of curvature positioned on the can axis and a radius of curvature smaller than a radius of curvature at a center of the dome part, and has a radius which is not less than a radius perpendicular to the can axis up to an outermost part from the can axis of the dome part in a vertical cross section view which includes the can axis and is along the direction of the can axis.

8. The method for producing a can container according to claim 7, wherein the forming tool is used as an inner tool and an outer tool which performs forming work on the annular convex part is used, and an inner peripheral surface of the annular convex part is subjected to the plastic work by compressing by the forming work of the dome part against which the inner tool is pressed.

* * * * *